US009831545B2

(12) United States Patent
Sugimoto et al.

(10) Patent No.: US 9,831,545 B2
(45) Date of Patent: Nov. 28, 2017

(54) ANTENNA DEVICE

(71) Applicant: DENSO CORPORATION, Kariya, Aichi-pref. (JP)

(72) Inventors: Yuji Sugimoto, Kariya (JP); Tadao Suzuki, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 211 days.

(21) Appl. No.: 14/391,561

(22) PCT Filed: Apr. 4, 2013

(86) PCT No.: PCT/JP2013/002336
§ 371 (c)(1),
(2) Date: Oct. 9, 2014

(87) PCT Pub. No.: WO2013/153784
PCT Pub. Date: Oct. 17, 2013

(65) Prior Publication Data

US 2015/0077305 A1 Mar. 19, 2015

(30) Foreign Application Priority Data

Apr. 13, 2012 (JP) ..... 2012-092006

(51) Int. Cl.
*H01Q 1/48* (2006.01)
*H01Q 9/30* (2006.01)
(Continued)

(52) U.S. Cl.
CPC ..... *H01Q 1/48* (2013.01); *H01Q 1/3275* (2013.01); *H01Q 9/30* (2013.01); *H01Q 9/32* (2013.01); *H01Q 21/28* (2013.01)

(58) Field of Classification Search
USPC ..... 343/848, 700 MS, 702
See application file for complete search history.

(56) References Cited

U.S. PATENT DOCUMENTS 6,809,687 B2 * 10/2004 Yuanzhu ..... H01Q 1/38 343/700 MS
7,106,256 B2 * 9/2006 Watanabe ..... H01Q 9/40 343/700 MS

FOREIGN PATENT DOCUMENTS

JP S4740268 Y1 12/1972
JP H1084207 A 3/1998
JP 2011250108 A 12/2011

OTHER PUBLICATIONS

International Search Report and Written Opinion (in Japanese with English Translation) for PCT/JP2013/002336, dated Jul. 2, 2013; ISA/JP.

* cited by examiner

*Primary Examiner* — Jessica Han
*Assistant Examiner* — Hai Tran
(74) *Attorney, Agent, or Firm* — Harness, Dickey & Pierce, P.L.C.

(57) ABSTRACT

An antenna device mounted on a roof surface of a vehicle roof includes a ground plate disposed on the roof surface, an antenna ground, a first antenna element, and a second antenna element. The antenna ground is disposed on a plane perpendicular to the ground plate apart from a ground plate surface by a predetermined distance in a direction perpendicular to the ground plate surface. The first antenna element, whose first base end portion is connected to a first predetermined position of the antenna ground, extends from the first base end portion to a first front end portion in a direction moving away from the antenna ground. The second antenna element, whose second base end portion is connected to a second predetermined position of the antenna ground, extends from the second base end portion to a second front end portion in a direction moving away from the antenna ground.

8 Claims, 5 Drawing Sheets

(51) Int. Cl.

| | |
|---|---|
| ***H01Q 1/32*** | (2006.01) |
| ***H01Q 9/32*** | (2006.01) |
| ***H01Q 21/28*** | (2006.01) |

ANTENNA DEVICE

CROSS REFERENCE TO RELATED APPLICATION

This application is a U.S. National Phase Application under 35 U.S.C. 371 of International Application No. PCT/JP2013/002336 filed on Apr. 4, 2013 and published in Japanese as WO 2013/153784 A1 on Oct. 17, 2013. This application is based on and claims priority to Japanese Patent Application No. 2012-092006 filed on Apr. 13, 2012. The entire disclosures of all of the above applications are incorporated herein by reference.

TECHNICAL FIELD

The present disclosure relates to an antenna device mounted on a surface of a vehicle roof made of metallic material.

BACKGROUND ART

Conventionally, an antenna device (also known as a vehicle roof mount antenna device) mounted on a surface of a vehicle roof is provided.

Generally, a surface of a vehicle roof is curved to have a smoothly projected shape. Thus, as shown in patent literature 1, when an antenna device is mounted on a surface of a vehicle roof at a back portion of the roof surface, a projected portion of the roof surface positioned in a front direction of the antenna device obstructs an operation of the antenna device. As a result, a gain of the antenna device in a front direction of the vehicle is difficult to be secured. Particularly, high-frequency radio wave having operating frequency band of gigahertz (GHz) band has a high rectilinearity and readily attenuates with an increase of a transmission distance. Thus, in the antenna device receiving the high-frequency radio waves having GHz frequency band, securing the gain in the front direction of the vehicle is especially important.

PRIOR ART LITERATURES

Patent Literature

Patent Literature 1: JP 2011-250108 A

SUMMARY OF INVENTION

In view of the foregoing difficulties, it is an object of the present disclosure to provide an antenna device in which an adverse effect caused by a projected shape of the roof surface to a radio wave transmitting and a radio wave receiving of the antenna device is reduced and a gain of the antenna device in a front direction of the vehicle can be properly secured when the antenna device is mounted on a roof surface of a vehicle roof made of metallic material.

According to an aspect of the present disclosure, an antenna device mounted on a roof surface of a vehicle roof includes a ground plate disposed on the roof surface, an antenna ground having a planar shape, a first antenna element, and a second antenna element. The antenna ground is disposed on a plane that is perpendicular to a ground plate surface of the ground plate or is angled with the ground plate surface of the ground plate within a predetermined angle. The antenna ground is disposed apart from the ground plate surface of the ground plate by a predetermined distance in a direction perpendicular to the ground plate surface of the ground plate. The first antenna element has a first base end portion and a first front end portion. The first base end portion is connected to a first predetermined position of the antenna ground, and the first antenna element extends from the first base end portion to the first front end portion in a direction moving away from the antenna ground. The second antenna element has a second base end portion and a second front end portion. The second base end portion is connected to a second predetermined position of the antenna ground. The second predetermined position is different from the first predetermined position. The second antenna element extends from the second base end portion to the second front end portion in a direction moving away from the antenna ground.

With the above antenna device, when the antenna device is mounted on the roof surface of the vehicle roof made of metallic material, an adverse effect caused by a projected shape of the roof surface to a radio wave transmitting and a radio wave receiving of the antenna device is reduced and a gain of the antenna device in the front direction of the vehicle can be properly secured.

BRIEF DESCRIPTION OF DRAWINGS

The above and other objects, features and advantages of the present disclosure will become more apparent from the following detailed description made with reference to the accompanying drawings. In the drawings.

EMBODIMENTS FOR CARRYING OUT INVENTION

First Embodiment

Figure 1:
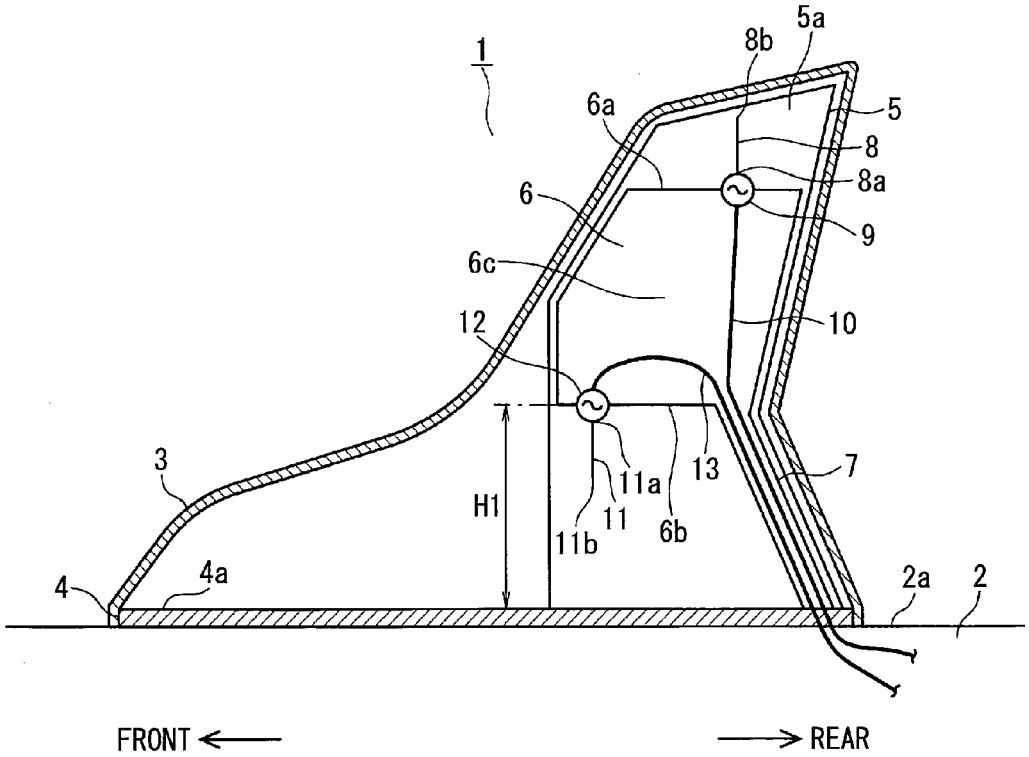
FIG. 1 is a diagram showing a longitudinal front view of an antenna device according to a first embodiment of the present disclosure.
Figure 2A:
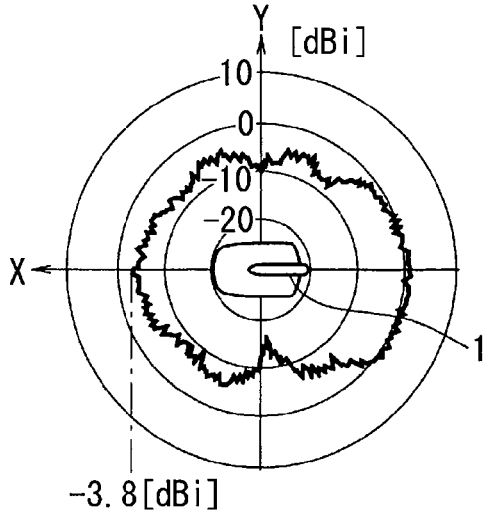
FIG. 2(*a*) and FIG. 2(*b*) are diagrams showing directivities of the antenna device on a horizontal plane according to the first embodiment, and FIG. 2(*c*) is a diagram showing a directivity of a comparison example of an antenna device.
Figure 2B:
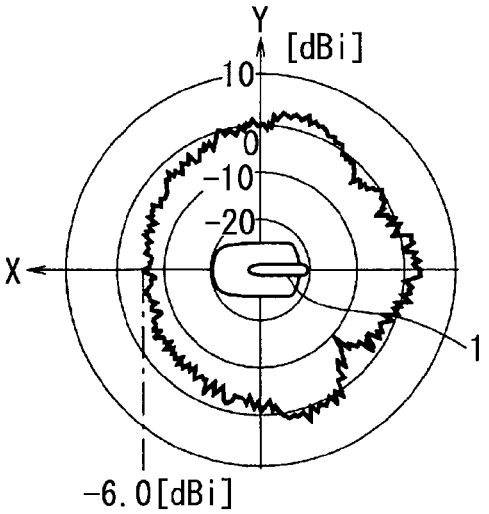
Figure 2C:
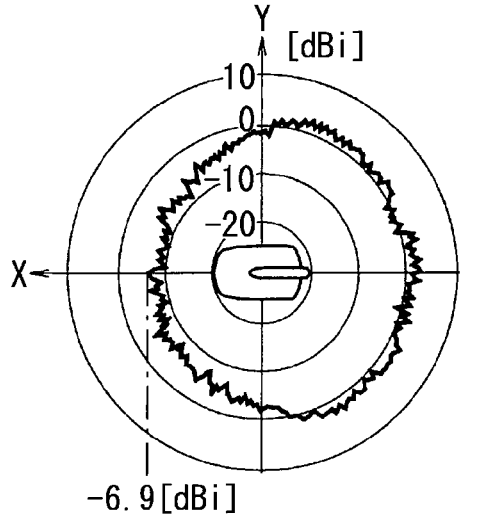
Figure 3A:
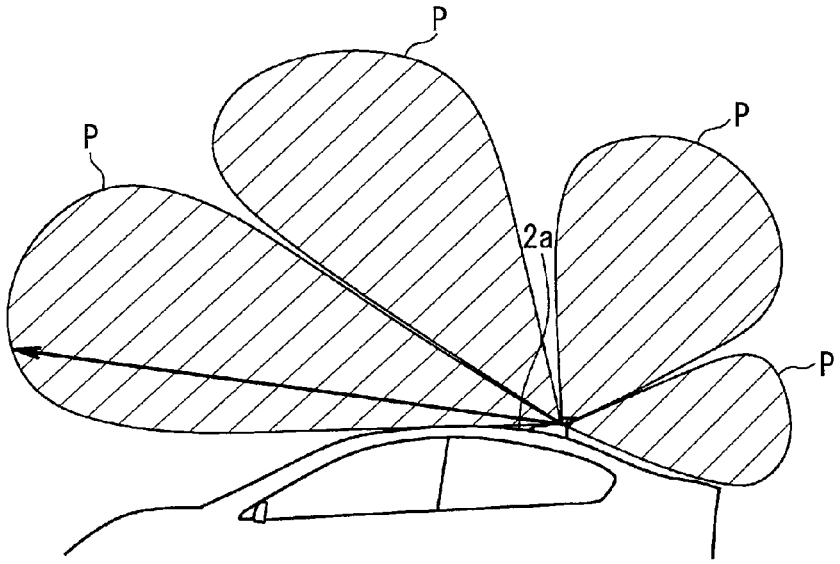
FIG. 3(*a*) is a diagram showing an electrical field distribution of an antenna device according to the first embodiment, and FIG. 3(*b*) is a diagram showing an electrical field distribution of a comparison example of an antenna device.
Figure 3B:
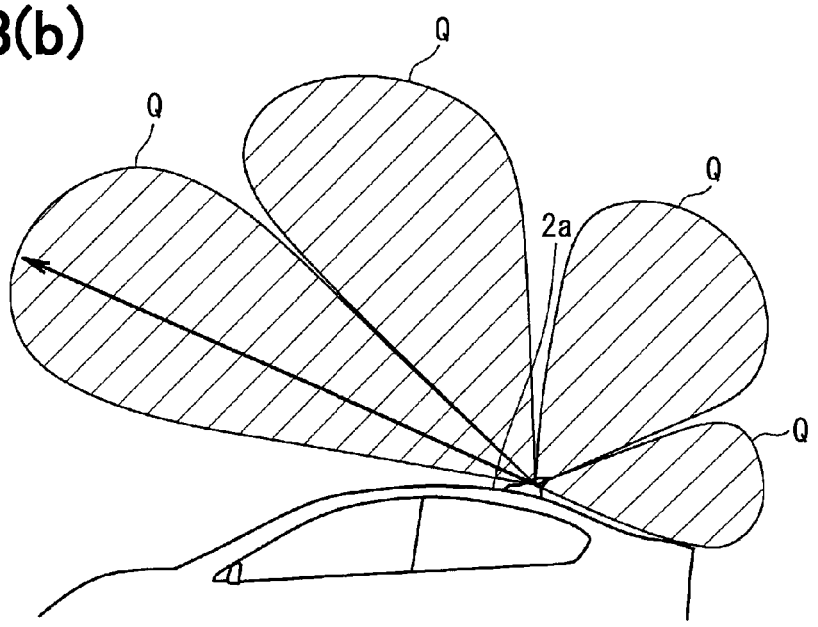

The following will describe an antenna device 1 according to a first embodiment of the present disclosure with reference to FIG. 1 to FIG. 3. The antenna device 1 is an antenna device (also known as a vehicle roof mount antenna device) that is mountable on a surface 2*a* of a vehicle roof 2 made of metallic material. The antenna device 1 is utilized in a vehicle-to-vehicle communication system operating at a frequency band of, for example, 5.9 gigahertz (GHz) band. The antenna device 1 has a casing 3. The casing 3 has a streamlined shape in a front (FRONT) to rear (REAR) direction with respect to a vehicle in order to reduce an air resistance during a traveling of the vehicle or for a reason of appearance design. For example, the antenna device 1 may have a shark-fin shape.

The antenna device 1 has a ground plate 4. The ground plate 4 has an approximately rectangular planar shape. For example, the ground plate 4 may be provided by a metal plate. Under a state that the antenna device 1 is mounted on the roof surface 2*a* of the vehicle roof 2, the ground plate 4 is disposed along the roof surface 2*a* of the vehicle roof 2. On a ground plate surface 4*a* of the ground plate 4, which is an upper surface of the ground plate 4, a substrate 5 is disposed in a standing manner. For example, the substrate 5 has a planar shape and is made of resin material. That is, a plane on which the substrate 5 is disposed may be perpendicular to the ground plate surface 4*a* of the ground plate 4. Alternatively, the plane on which the substrate 5 is disposed may be angled with a direction perpendicular to the ground plate surface 4*a* of the ground plate 4 within a predetermined angle. The substrate 5 is shaped to track a shape of the casing 3. On one surface 5*a* of the substrate 5, an antenna ground 6 and a connection portion 7 provided by conductor pattern (conductor film) are disposed. The connection portion 7 electrically connects the antenna ground 6 with the ground plate 4. That is, the antenna ground 6 is conductive with the ground plate 4 via the connection portion 7. That is, the antenna ground 6 is disposed apart from the ground plate surface 4*a* of the ground plate 4 by a predetermined distance. The antenna ground 6 is formed on one surface 5*a* of the substrate 5. Thus, the antenna ground 6 is perpendicular to the ground plate surface 4*a* of the ground plate 4 or is angled with the direction perpendicular to the ground plate surface 4*a* of the ground plate 4 within the predetermined angle. The antenna ground 6 is connected with the ground plate 4 via the connection portion 7, and has an electrical potential equal to an electrical potential of the ground plate 4. The antenna ground 6 has a rectangular shape, and has a predetermined length in the direction perpendicular to the ground plate 4 and has a predetermined length in a direction, which is parallel to the ground plate 4 along the antenna ground 6. Hereinafter, the direction perpendicular to the ground plate 4 is also referred to as a vertical direction, and a direction parallel to the ground plate 4 is also referred to as a horizontal direction. Further, an axis parallel to a front-rear direction of the vehicle is defined as an X axis, an axis perpendicular to the plane on which the substrate 5 is disposed is defined as a Y axis, and a plane defined by the X axis and the Y axis is defined as a horizontal plane (X-Y plane).

A first antenna element 8 is disposed at an upper end portion 6*a* of the antenna ground 6. The first antenna element 8 is provided by a linear monopole antenna element that transmits and receives vertically polarized waves. The position at which the first antenna element 8 is disposed is also referred to as a first predetermined position. In the present embodiment, the first predetermined position is the upper end portion 6*a* of the antenna ground 6. The first antenna element 8 has a base end portion 8*a* and a frond end portion 8*b*. The base end portion 8*a* and the front end portion 8*b* are referred to as a first base end portion and a first front end portion, respectively. The base end portion 8*a* is electrically connected with the upper end portion 6*a* of the antenna ground 6. The first antenna element 8 is connected with the antenna ground 6 so that the first antenna element 8 extends in a direction from the base end portion 8*a* to the front end portion 8*b*, and the direction from the base end portion 8*a* to the front end portion 8*b* is a direction moving away from the antenna ground 6 in an approximately vertical direction. That is, the first antenna 8 is disposed such that a central axis of the first antenna element 8 is perpendicular to the ground plate surface 4*a* of the ground plate 4 or is angled with the direction perpendicular to the ground plate surface 4*a* of the ground plate 4 within the predetermined angle. Herein, the central axis of the antenna element refers to a longitudinal central axis of the antenna element. The first antenna element 8 has a length (element length) that is electrically equal to quarter wavelength. For example, the element length may be set equal to a length acquired by multiplying quarter wavelength of 5.9 GHz radio wave with a wavelength shortening rate defined by a relative permittivity of material of the substrate 5. A feeding point 9 that supplies power to the first antenna element 8 is provided at the base end portion 8*a* of the first antenna element 8. When the feeding point 9 is positioned apart from the first antenna element 8, the feeding point 9 may be electrically connected with the base end portion 8*a* of the first antenna element 8 via a microstripline. For example, the feeding point 9 may be configured such that an internal conductor of a first coaxial cable 10 is connected with the base end portion 8*a* of the first antenna element 8 and an external conductor of the first coaxial cable 10 is connected with the antenna ground 6. The first antenna element 8 is disposed so that a height from the ground plate surface 4*a* to the base end portion 8*a* is approximately equal to 40 millimeters (mm).

A second antenna element 11 is disposed at a lower end portion 6*b* of the antenna ground 6. The second antenna element 11 is provided by a linear monopole antenna element that transmits and receives vertically polarized waves. The position at which the second antenna element 11 is disposed is also referred to as a second predetermined position. In the present embodiment, the second predetermined position is the lower end portion 6*b* of the antenna ground 6. The second antenna element 11 has a base end portion 11*a* and a frond end portion 11*b*. The base end portion 11*a* and the front end portion 11*b* are referred to as a second base end portion and a second front end portion, respectively. The base end portion 11*a* is electrically connected with the lower end portion 6*b* of the antenna ground 6. The second antenna element 11 is connected with the antenna ground 6 so that the second antenna element 11 extends in a direction from the base end portion 11*a* to the front end portion 11*b*, and the direction from the base end portion 11*a* to the front end portion 11*b* is a direction moving away from the antenna ground 6 in the approximately vertical direction. That is, the second antenna 11 is disposed such that a central axis of the second antenna element 11 is perpendicular to the ground plate surface 4*a* of the ground plate 4 or is angled with the direction perpendicular to the ground plate surface 4*a* of the ground plate 4 within the predetermined angle. The second antenna element 11 has a length (element length) that is electrically equal to quarter wavelength. For example, the element length may be set equal to the length acquired by multiplying quarter wavelength of 5.9 GHz radio wave with the wavelength shortening rate defined by the relative permittivity of material of the substrate 5. A feeding point 12 that supplies power to the second antenna element 11 is provided at the base end portion 11*a* of the second antenna element 11. When the feeding point 12 is positioned apart from the second antenna element 11, the feeding point 12 may be electrically connected with the base end portion 11*a* of the second antenna element 11 via a microstripline. For example, the feeding point 12 may be configured such that an internal conductor of a second coaxial cable 13 is connected with the base end portion 11*a* of the second antenna element 11 and an external conductor of the second coaxial cable 13 is connected with the antenna ground 6. The second antenna element 11 is disposed so that a height from the ground plate surface 4*a* to the base end portion 11*a* is approximately equal to 20 mm.

Figure 7:
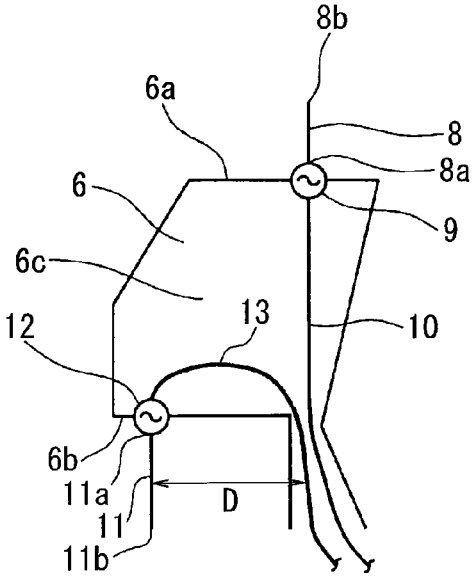
FIG. 7 is a diagram showing an arrangement of an antenna element and a cable.

The central axis of the first antenna element 8 is displaced from a center portion 6*c* of the antenna ground 6 in a horizontal direction, and the central axis of the second antenna element 11 is displaced from the center portion 6*c* of the antenna ground 6 in the horizontal direction. In the horizontal direction, the antenna ground 6 may have a width greater than, for example, the length acquired by multiplying quarter wavelength of 5.9 GHz radio wave with the wavelength shortening rate defined by the relative permittivity of material of the substrate 5. Further, a distance between the feeding point 9 and the feeding point 12 is required to be set so that an interference between the first antenna element 8 and the second antenna element 11, which provide a spatial diversity, is restricted. For example, the distance between the feeding point 9 and the feeding point 12 may be set greater than a length acquired by multiplying half wavelength of 5.9 GHz radio wave with the wavelength shortening rate defined by the relative permittivity of material of the substrate 5. Further, a distance D between the second antenna element 11 and the second coaxial cable 13 is required to be set so that a reflex action of the second coaxial cable 13 is restricted. For example, the distance D may be set greater than the length acquired by multiplying quarter wavelength of 5.9 GHz radio wave with the wavelength shortening rate defined by the relative permittivity of material of the substrate 5. FIG. 7 shows an example of the distance D between the second antenna element 11 and the second coaxial cable 13. As shown in FIG. 7, a distance between a part of the coaxial cable 13 that is approximately parallel to the antenna element 11 and the antenna element 11 may be defined as the distance D between the second antenna element 11 and the second coaxial cable 13, and the distance D may be set greater than the length acquired by multiplying quarter wavelength of 5.9 GHz radio wave with the wavelength shortening rate defined by the relative permittivity of material of the substrate 5. The predetermined distance from the ground plate surface 4*a* to the antenna ground 6 may be set with consideration of, for example, a size of the casing 3, a slope of the roof surface 2*a*, a sensitivity of each of the first antenna element 8 and the second antenna element 11.

FIG. 2(*a*) shows a simulation result of a directivity of the first antenna element 8 of the antenna device 1 shown in FIG. 1 on the horizontal plane (X-Y plane), and FIG. 2(*b*) shows a simulation result of a directivity of the second antenna element 11 of the antenna device 1 shown in FIG. 1 on the horizontal plane (X-Y plane). Herein, an antenna device having a conventional structure (not shown) in which the base end portion of the antenna element is directly connected with the ground plate surface is described as a comparison example. Suppose that both the antenna device 1 according to the present disclosure and the comparison example of the antenna device are mounted on a rear portion of the roof surface 2*a* having the smoothly projected shape. As shown in FIG. 2(*a*), a gain of the first antenna element 8 disposed at an upper side of the antenna ground 6 is −3.8 decibel [dBi] in the front direction with respect to the vehicle. As shown in FIG. 2(*c*), a gain of the antenna element of the antenna device having the conventional structure is −6.9 [dBi] in the front direction with respect to the vehicle. Thus, the gain of the first antenna element 8 disposed at the upper side of the antenna ground 6 is higher than the gain of the antenna element of the antenna device having the conventional structure by approximately 3 [dB]. Further, as shown in FIG. 2(*b*), a gain of the second antenna element 11 disposed at a lower side of the antenna ground 6 is −6.0 [dBi] in the front direction with respect to the vehicle. Thus, the gain of the second antenna element 11 disposed at the lower side of the antenna ground 6 is higher than the gain of the antenna element of the antenna device having the conventional structure by approximately 1 [dB].

In the antenna device having the conventional structure, the antenna element is directly connected with the ground plate surface. Thus, when the antenna device is mounted on the roof surface 2*a* that has a smoothly projected surface, the projected shape of the roof surface 2*a* obstructs a front visibility of the antenna element. Further, the antenna element is disposed close to the roof surface 2*a*, radio waves reflected on the roof surface adversely affect the antenna device. Thus, as shown in FIG. 3(*b*), an electrical field pattern Q of the comparison example is oriented toward an upper direction. In the antenna device 1 according to the present embodiment, the first antenna element 8 and the second antenna element 11 are connected with the antenna ground 6 at positions that are apart from the ground plate surface 4*a* by respective predetermined distances. That is, the antenna elements 8, 11 are disposed apart from the roof surface 2*a* by respective predetermined distances. Thus, even when the antenna device 1 is mounted on the roof surface 2*a* having the projected shape, the visibilities of the first antenna element 8 and the second antenna element 11 in the front direction of the vehicle are less obstructed, or not obstructed by the projected roof surface 2*a*. Further, the first antenna element 8 and the second antenna element 11 are disposed apart from the roof surface 2 by the respective predetermined distances. Thus, the first antenna element 8 and the second antenna element 11 are less likely to be affected by the radio waves reflected on the roof surface 2*a*. Thus, as shown in FIG. 3(*a*), an electrical field pattern P of the antenna device 1 is oriented to the horizontal direction, not to the upper direction. As a result, in the antenna device 1, the gain in the front direction of the vehicle is secured.

As described above, in the antenna device 1 according to the first embodiment, the antenna ground 6 is disposed apart from the ground plate surface 4*a* of the ground plate 4 by the predetermined distance in the vertical direction. The first antenna element 8 and the second antenna element 11 are provided to the antenna ground 6 so that the first antenna element 8 and the second antenna element 11 perform diversity reception. That is, the first antenna element 8 and the second antenna element 11 are provided to the antenna ground 6 so that the first antenna element 8 and the second antenna element 11 provides the diversity reception in which the radio waves are received in diversity scheme. With this configuration, when the antenna device 1 is mounted on the rear portion of the roof surface 2*a* so that the ground plate surface 4*a* of the ground plate 4 is disposed along the roof surface 2*a* of the vehicle roof having the projected shape, the projected portion of the roof surface does not obstruct the radio wave reception of the antenna device 1 and an adverse effect caused by the projected shape of the roof surface 2*a* is reduced. Thus, visibilities (ranges of view) of the first antenna element 8 and the second antenna element 11 in the front direction of the vehicle are properly secured, and the gain of the antenna device 1 in the front direction of the vehicle is properly secured. The antenna device 1 performs the spatial diversity reception with the first antenna element 8 and the second antenna element 11. Thus, sensitivity of the antenna device 1 is improved.

In the first embodiment, the antenna ground 6 and the ground plate 4 have the same electrical potential. Thus, signals received by the first antenna element 8 and second antenna element 11 can be directly transmitted to the electronic circuit components of the ground plate 4 (wireless device or the like). Thus, signal transmission can be performed in a simple way. The distance between the second antenna element 11 and the second coaxial cable 13 is set greater than the length acquired by multiplying quarter wavelength of 5.9 GHz radio wave with the wavelength shortening rate defined by the relative permittivity of material of the substrate 5. Thus, the reflex action of the second coaxial cable 13 is restricted. The length of the antenna ground 6 in the horizontal direction is set equal to the length acquired by multiplying quarter wavelength of 5.9 GHz radio wave with the wavelength shortening rate defined by the relative permittivity of material of the substrate 5. Thus, current paths are increased and broader frequency band can be provided by the antenna device 1.

Second Embodiment

Figure 4:
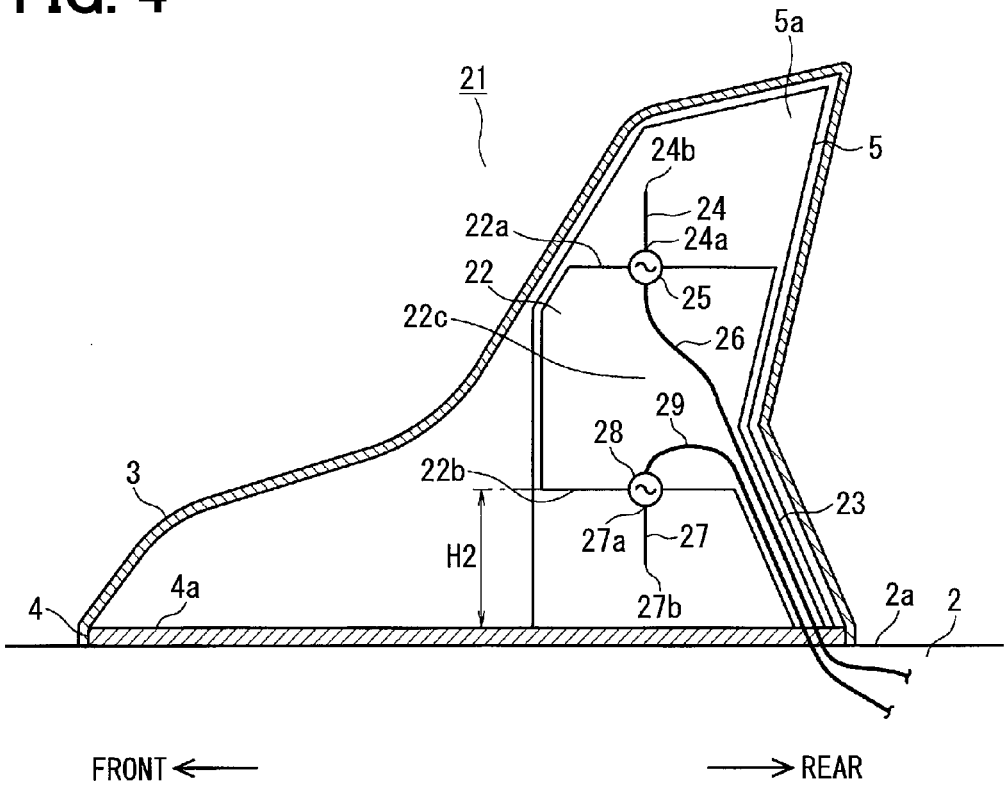
FIG. 4 is a diagram showing a longitudinal front view of an antenna device according to a second embodiment of the present disclosure.
Figure 5:
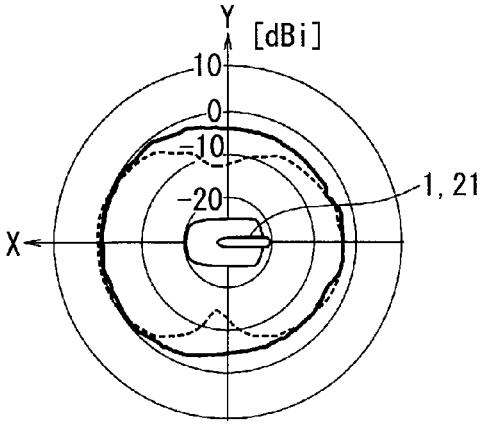
FIG. 5 is a diagram showing an electrical field distribution of an antenna device according to the second embodiment.

The following will describe an antenna device 21 according to a second embodiment of the present disclosure with reference to FIG. 4 and FIG. 5. A description of the same part with the above-described first embodiment will be omitted, and different parts will be described. In the second embodiment, the position of the monopole antenna element with respect to the antenna ground is different from the first embodiment. In the antenna device 1 according to the first embodiment, the first antenna element 8 and the second antenna element 11 are disposed apart from one another in the horizontal direction viewed from the center portion 6*c* of the antenna ground 6. That is, the axis of the first antenna element 8 disposed at the upper side, the center portion 6*c* of the antenna ground 6, and the axis of the second antenna element 11 disposed at the lower side are not disposed on the same line. In the antenna device according to the second embodiment, an axis of a first antenna element 24, a center portion of an antenna ground, and an axis of a second antenna element 27 are disposed on the same line.

The antenna device 21 has the antenna ground 22. The antenna ground 22 is disposed more adjacent to the ground plate 4 compared with the antenna ground 6 of the first embodiment. As shown in FIG. 4, a distance H2 between a lower end portion 22*b* of the antenna ground 22 to the ground plate 4 is shorter than the distance H1 from the lower end portion 6*b* of the antenna ground 6 shown in FIG. 1 (H2<H1). The antenna ground 22 has a connection portion 23. The antenna ground 22 has an electrical potential equal to an electrical potential of the ground plate 4 through the connection portion 23. The upper end portion 22*a* of the antenna ground 22 is connected with the first antenna element 24. The first antenna element 24 is provided by a linear monopole antenna element that transmits and receives vertically polarized waves. The position at which the first antenna element 24 is disposed is also referred to as a first predetermined position. In the present embodiment, the first predetermined position is the upper end portion 22*a* of the antenna ground 22. The first antenna element 24 is connected with the antenna ground 22 so that the first antenna element 24 extends in a direction from the base end portion 24*a* (first base end portion) to the front end portion 24*b* (first front end portion), and the direction from the base end portion 24*a* to the front end portion 24*b* is a direction moving away from the antenna ground 22 in the approximately vertical direction. That is, the first antenna 24 is disposed such that the central axis of the first antenna element 24 is perpendicular to the ground plate surface 4*a* of the ground plate 4, or the central axis of the first antenna element 24 is angled with the direction perpendicular to the ground plate surface 4*a* of the ground plate 4 within the predetermined angle. A feeding point 25 is provided at the base end portion 24*a* of the first antenna element 24, and the feeding point 25 is connected with a first coaxial cable 26.

The second antenna element 27 is disposed at a lower end portion 22*b* of the antenna ground 22. The second antenna element 27 is provided by a linear monopole antenna element that transmits and receives vertically polarized waves. The position at which the second antenna element 27 is disposed is also referred to as a second predetermined position. In the present embodiment, the second predetermined position is the lower end portion 22*b* of the antenna ground 22. The second antenna element 27 is connected with the antenna ground 22 so that the second antenna element 27 extends in a direction from the base end portion 27*a* (second base end portion) to the front end portion 27*b* (second front end portion), and the direction from the base end portion 27*a* to the front end portion 27*b* is a direction moving away from the antenna ground 22 in the approximately vertical direction. That is, the second antenna 27 is disposed such that the central axis of the second antenna element 27 is perpendicular to the ground plate surface 4*a* of the ground plate 4, or the central axis of the second antenna element 27 is angled with the direction perpendicular to the ground plate surface 4*a* of the ground plate 4 within the predetermined angle. A feeding point 28 is provided at the base end portion 27*a* of the second antenna element 27, and the feeding point 28 is connected with a second coaxial cable 29.

The axis of the first antenna element 24 and the axis of the second antenna element 27 are not displaced from the center portion 22*c* of the antenna ground 22 in the horizontal direction. That is, the axis of the first antenna element 24, the axis of the second antenna element 27, and the center portion 22*a* of the antenna ground 22 are disposed on the same line that is approximately perpendicular to the ground plate surface 4*a* of the ground plate 4.

In FIG. 5, a solid line shows a simulation result of a directivity of the first antenna element 24 and the second antenna element 27 in the configuration shown in FIG. 4 on the horizontal plane (X-Y plane). In FIG. 5, a dashed line shows a simulation result of a directivity of the first antenna element 8 and the second antenna element 11 in the antenna device according to the first embodiment shown in FIG. 1 on the horizontal plane (X-Y plane). In the antenna device 1 according to the first embodiment shown in FIG. 1, the axis of the first antenna element 8 and the axis of the second antenna element 11 are displaced from the center portion 6*c* of the antenna ground 6 in the horizontal direction. Thus, a polarization plane of the antenna device 1 is slanted, and a sensitivity of the antenna device 1 is substantially degraded at some points. Hereinafter, the point at which the sensitivity is substantially degraded is referred to as a null point. In the configuration according to the second embodiment shown in FIG. 4, the axis of the first antenna element 24 and the axis of the second antenna element 27 are not displaced from the center portion 22*c* of the antenna ground 22 in the horizontal direction. Thus, a polarization plane of the antenna device 21 is not slanted, and the point at which a sensitivity of the antenna device 21 is substantially degraded is not generated.

The antenna device 21 according to the second embodiment provides advantages similar to the advantages provided by the antenna device 1 according to the first embodiment. The axis of the first antenna element 24, the axis of the second antenna element 27, and the center portion 22*a* of the antenna ground 22 are disposed on the same line that is approximately perpendicular to the ground plate surface 4*a* of the ground plate 4. Thus, a polarization plane of the antenna device 21 is not slanted, and the antenna device 21 functions as a non-directional antenna device.

Third Embodiment

Figure 6:
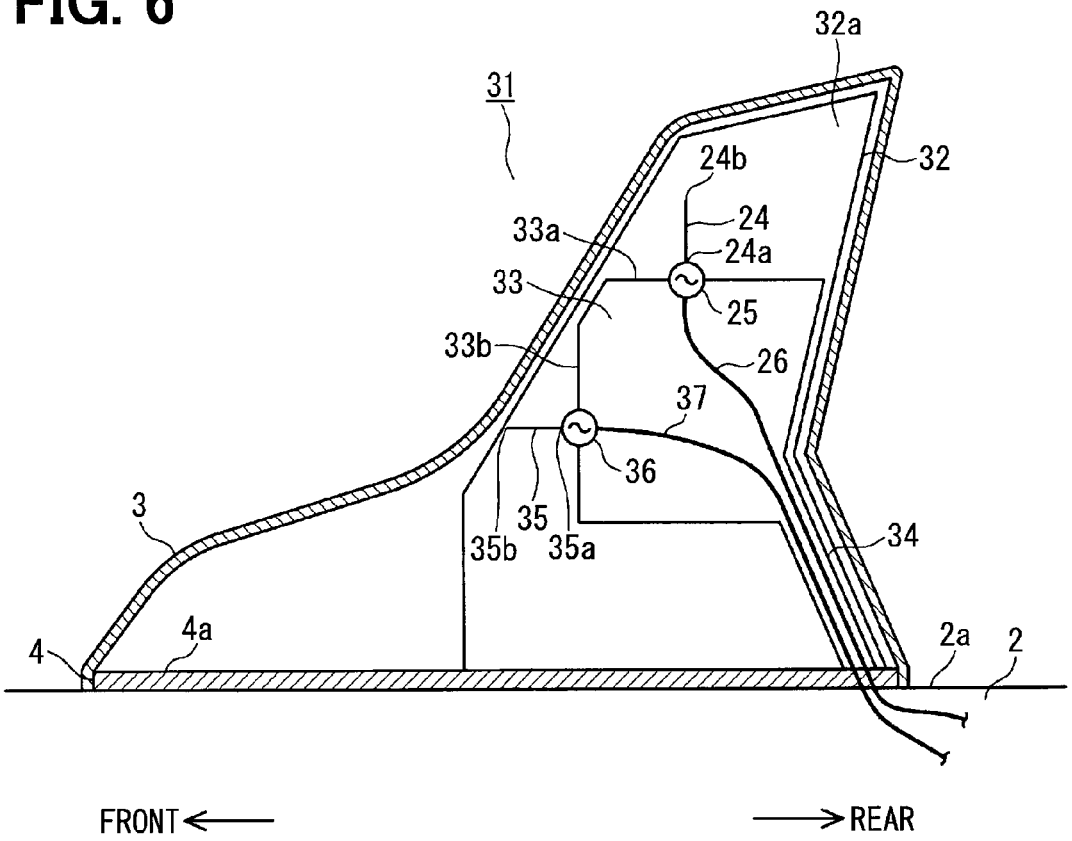
FIG. 6 is a diagram showing a longitudinal front view of an antenna device according to a third embodiment of the present disclosure.

The following will describe an antenna device 31 according to a third embodiment of the present disclosure with reference to FIG. 6. A description of the same part with the above-described first embodiment will be omitted, and different parts will be described. In the antenna device 1 according to the first embodiment, the first antenna element 8 and the second antenna element 11 are disposed perpendicular to the antenna ground 6. In the antenna device 31 according to the third embodiment, one of the two antenna elements is disposed perpendicular to the antenna ground, and the other of the two antenna elements is disposed in the horizontal direction relative to the antenna ground.

As shown in FIG. 6, in the antenna device 31, a substrate 32 has a longer length in the direction perpendicular to the ground plate 4 and has a longer length in the horizontal direction of the ground plate 4 compared with the substrate 5 described in the first embodiment. On one surface 32*a* of the substrate 32, an antenna ground 33 and a connection portion 34 provided by conductor pattern are disposed. The connection portion 34 electrically connects the antenna ground 33 with the ground plate 4. That is, the antenna ground 33 is conductive with the ground plate 4 via the connection portion 34.

The antenna ground 33 has an upper end portion 33*a* to which the first antenna element 24 described in the second embodiment is connected. The position at which the first antenna element 24 is disposed is also referred to as a first predetermined position. In the present embodiment, the first predetermined position is the upper end portion 33*a* of the antenna ground 33. A feeding point 25 is provided at the base end portion 24*a* of the first antenna element 24, and the feeding point 25 is connected with the first coaxial cable 26. A second antenna element 35 is disposed at a side end portion 33*b* of the antenna ground 33. The second antenna element 35 is provided by a linear monopole antenna element that transmits and receives horizontally polarized waves. The position at which the second antenna element 35 is disposed is also referred to as a second predetermined position. In the present embodiment, the second predetermined position is the side end portion 33*b* of the antenna ground 33. The second antenna element 35 is connected with the antenna ground 33 so that the second antenna element 35 extends in a direction from a base end portion 35*a* (second base end portion) to a front end portion 35*b* (second front end portion), and the direction from the base end portion 35*a* to the front end portion 35*b* is a direction moving away from the antenna ground 33 in an approximately horizontal direction. That is, the second antenna 35 is disposed such that a central axis of the second antenna element 35 is in the horizontal direction with respect to the ground plate surface 4*a* of the ground plate 4, or is disposed such that the central axis of the second antenna element 35 is angled with the horizontal direction with respect to the ground plate surface 4*a* of the ground plate 4 within the predetermined angle. A feeding point 36 is provided at the base end portion 35*a* of the second antenna element 35, and the feeding point 36 is connected with a second coaxial cable 37.

The antenna device 31 according to the third embodiment provides advantages similar to the advantages provided by the antenna device 1 according to the first embodiment. The first antenna element 24 and the second antenna element 35 are provided to the antenna ground 33 so that the first antenna element 24 and the second antenna element 35 provides the polarized diversity reception in which the radio waves are received in polarized diversity scheme. With this configuration, the antenna device 31 performs the polarized diversity reception by the first antenna element 24 and the second antenna element 35. Thus, the antenna device 31 is able to receive both vertically polarized waves and the horizontally polarized waves.

Other Embodiments

In the foregoing embodiments, the antenna ground and the ground plate have the same electrical potential. Alternatively, the antenna ground may have an electrical potential different from an electrical potential of the ground plate.

The substrate may be provided by a multi-layer substrate having multiple layers. The antenna elements performing the diversity reception may be disposed on the same layer, or may be disposed on different layers. The substrate may be provided by a substrate that is flexible at a predetermined level. The substrate may be provided by a substrate on which electronic components are mountable. That is, under a condition that multiple antenna elements can be formed on the substrate, any kind of substrate can be used. Similarly, the ground plate on which the substrate is disposed in a standing manner may be provided by a plate curved at a predetermined level under a condition that the plate functions as an antenna ground of the antenna elements provided to the substrate, other than a perfectly planar-shaped plate.

The antenna element may be provided by a metal plate or the like.

In the third embodiment, the second antenna element 35 that transmits and receives horizontally polarized waves may be provided by a low postured reversed L-shaped antenna element While the disclosure has been described with reference to preferred embodiments thereof, it is to be understood that the disclosure is not limited to the preferred embodiments and constructions. The disclosure is intended to cover various modification and equivalent arrangements. In addition, while the various combinations and configurations, which are preferred, other combinations and configurations, including more, less or only a single element, are also within the spirit and scope of the disclosure.

What is claimed is:

1. An antenna device mounted on a roof surface of a vehicle roof comprising:

a ground plate disposed on the roof surface;

a single antenna ground having a planar shape, the single antenna ground being disposed on a plane that is perpendicular to a ground plate surface of the ground plate or being angled with the ground plate surface of the ground plate within a predetermined angle;

a connection portion electrically connecting the ground plate and the single antenna ground in such a manner that the single antenna ground is disposed apart from the ground plate surface of the ground plate by a predetermined distance in a direction perpendicular to the ground plate surface of the ground plate;

a first antenna element having a first base end portion and a first front end portion, the first base end portion being connected to a first predetermined position of the single antenna ground, and the first antenna element extending from the first base end portion to the first front end portion in a direction moving away from the single antenna ground; and a second antenna element having a second base end portion and a second front end portion, the second base end portion being connected to a second predetermined position of the single antenna ground, the second predetermined position being different from the first predetermined position, and the second antenna element extending from the second base end portion to the second front end portion in a direction moving away from the single antenna ground.

2. The antenna device according to claim 1, wherein the first antenna element and the second antenna element provide a diversity reception.

3. The antenna device according to claim 1, wherein the antenna ground has an electrical potential equal to an electrical potential of the ground plate.

4. The antenna device according to claim 2, wherein both a central axis of the first antenna element and a central axis of the second antenna element are perpendicular to the ground plate surface of the ground plate, or angled with the direction that is perpendicular to the ground plate surface of the ground plate within a predetermined angle, and wherein the first antenna element and the second antenna element provide a spatial diversity reception.

5. The antenna device according to claim 4, wherein the central axis of the first antenna element, the central axis of the second antenna element, and a center portion of the antenna ground are disposed on a same line.

6. The antenna device according to claim 2, wherein a central axis of the first antenna element is perpendicular to the ground plate surface of the ground plate, or angled with the direction that is perpendicular to the ground plate surface of the ground plate within a predetermined angle, wherein a central axis of the second antenna element is disposed in a horizontal direction with respect to the ground plate surface of the ground plate, or angled with the horizontal direction with respect to the ground plate surface of the ground plate within a predetermined angle, and wherein the first antenna element and the second antenna element provide a polarized diversity reception.

7. The antenna device according to claim 1, wherein the first base end portion of the first antenna element is connected to an upper end of the single antenna ground and the second base end portion of the second antenna element is connected to a lower end of the single antenna ground.

8. The antenna device according to claim 1, wherein the first base end portion of the first antenna element is connected to an upper end of the single antenna ground and the second base end portion of the second antenna element is connected to a side end portion of the single antenna ground.

* * * * *